US008182151B2

(12) United States Patent
Dodgen

(10) Patent No.: US 8,182,151 B2
(45) Date of Patent: May 22, 2012

(54) HYDRATION SYSTEM WITH DISPOSABLE BAG AND SLEEVE FASTENING ASSEMBLY

(76) Inventor: David Dodgen, Round Rock, TX (US)

( * ) Notice: Subject to any disclaimer, the term of this patent is extended or adjusted under 35 U.S.C. 154(b) by 292 days.

(21) Appl. No.: 12/623,409

(22) Filed: Nov. 21, 2009

(65) Prior Publication Data

US 2010/0127007 A1 May 27, 2010

Related U.S. Application Data

(60) Provisional application No. 61/116,886, filed on Nov. 21, 2008.

(51) Int. Cl.

| | |
|---|---|
| ***B65D 33/16*** | (2006.01) |
| ***B65D 33/06*** | (2006.01) |
| ***B67D 7/84*** | (2010.01) |
| ***A47G 19/22*** | (2006.01) |

(52) U.S. Cl. ..... 383/80; 383/6; 383/906; 222/175; 220/705

(58) Field of Classification Search ..... 383/80, 383/6, 906; 222/175; 220/705
See application file for complete search history.

(56) References Cited

U.S. PATENT DOCUMENTS

| | | | | |
|---|---|---|---|---|
| 1,769,259 | A * | 7/1930 | Henry | 383/66 |
| 5,882,119 | A * | 3/1999 | Fadal, II | 383/80 |
| 7,066,337 | B2 * | 6/2006 | Hsu | 210/452 |
| 2006/0255048 | A1 * | 11/2006 | Bemis | 220/703 |
| 2009/0242587 | A1 * | 10/2009 | Bemis | 222/92 |

* cited by examiner

*Primary Examiner* — Jes F Pascua
(74) *Attorney, Agent, or Firm* — Rick B. Yeager

(57) ABSTRACT

A disposable bag hydration system. A reusable bag sleeve fastening assembly comprises an inner sleeve, an outer sleeve, and a cap. A lip portion of the inner sleeve is inserted into a bag fill hole, and the outer sleeve is positioned over the inner sleeve. A periphery area of bag material around the hole is sealed between portions of inner sleeve and the outer sleeve. A drinking tube is attached to a cap which is secured to the outer sleeve.

12 Claims, 9 Drawing Sheets

80
81
133
120
122

142
140

98
97

160
120
140
162

166
160
140

HYDRATION SYSTEM WITH DISPOSABLE BAG AND SLEEVE FASTENING ASSEMBLY

RELATED APPLICATIONS

This non-provisional patent application is related to U.S. Provisional Patent Application No. 61/116,886 filed Nov. 21, 2008 by applicant and claims the priority data of that provisional application.

BACKGROUND OF THE INVENTION

1. Field of Invention

The present invention relates generally to reusable sleeve devices to fasten a temporary liquid storage container to a dispensing tube having a mouthpiece. The present invention relates more specifically as an enhancement to existing backpack hydration products, such as the Camelbak™, and as an adaptation of the Aquapodkit™.

2. Prior Art

Prior art backpack type products provide a hands-free hydration system to the customer who is drawn to the outdoors and/or activity. The reservoirs of these products must be cleaned with mild soap, warm water and/or cleaning tablets. They must be dried completely. Sanitation issues are a consideration with these existing products. Staining and taste issues are problematic.

Prior Art Camelbak™ Device

Prior art hydration devices typically provide a reusable bag in a backpack or carrier. A fill port is provided in the upper portion of the bag and a discharge port is provided in the lower portion of the bag. A portion of the bag is typically permanently secured to a portion of the fill port assembly so that the seal between the fill port assembly and the bag is formed by an adhesive, heat sealing, or welding, such as ultrasonic or RF welding.

FIG. 1 is a top view and FIG. 2 is a side view of a prior art device described in U.S. Pat. No. 6,820,780 to Forsman et al and assigned to CamelBak Products LLC. The device includes a fluid reservoir, or bladder, 12 with an internal compartment 16, which is adapted to store a volume of drink fluid 18. The device includes a drinking tube 22 which is attached to a lower discharge or exit port 32. The reservoir 12 includes an input port, or fill port, 40 through which drink fluid 18 may be poured into or removed from the reservoir. Fill port 40 also provides a passage through which the interior of compartment 16 may be accessed, such as for cleaning. As shown, fill port 40 includes a neck, or neck portion, 42 that extends from the body portion of the reservoir and includes an opening 44 through which drink fluid may exit the fill port. As illustrated in FIG. 3, which is an end view of the prior art device, the neck 42 may be integrally formed with reservoir 12, or separately formed and then joined to the reservoir, such as by a suitable sealing mechanism. Examples of suitable sealing mechanisms include the use of an adhesive, heat sealing, and welding, such as ultrasonic or RF welding.

Although the drinking tube could be removed from the reservoir and re-used, it is generally not practical to provide disposable bags or reservoirs for this type of design because in addition to the bag itself, portions of both the exit port assembly and the fill port assembly are permanently attached to the bag, and must be provided on the replacement bag. Therefore standard practice with these types of devices is to clean, attempt to dry, and then re-use the existing reservoir.

Prior Art Disposable Bags

U.S. Pat. No. 7,311,231 to Noell et al describes replacement or pre-filled bags with a shutoff or check valve provided on the exit port. In one embodiment, pre-filled bags are provided without the fill port. In another embodiment, bags have a fill port. In the case of user-filled replacement bags, this approach also appears to have the disadvantage of requiring portions of both the exit port assembly and the fill port assembly to be attached to the replacement bag.

Rigid Systems

U.S. Pat. No. 7,600,656 issued to Karl et al describes a rigid fluid container and cites problems with prior art bag designs:

"While some improvements have been made in such bag-like systems, the reservoirs of these systems are often expensive and difficult to clean due to their construction. Flexible or "soft-sided" reservoirs (e.g. bladders, bags, etc.) are typically constructed from two sheets of high grade plastic that are bonded or welded together along their edges to create a bag with water-tight seams. These bags then have components attached to them for filling and dispensing fluids, such as an input port with a large threaded neck to fill the bag which ice and water, and an output spout with a bonded or welded drink tube. The resulting reservoir is typically a water-tight, though expensive, assemblage of fused or bonded parts. These assemblages usually have many internal seams and corners that are difficult to clean with conventional methods. For example, these collapsible bags typically include small voids or traps that are difficult to clean and often require accessories for facilitating proper cleaning (e.g. a hanging rack, etc.) to permit cleaning fluid access and/or air circulation. In some cases, the difficulties associated with cleaning the bag tend to outweigh the usefulness of the hydration bag as a desirable system for providing hydration to a user."

Aquapodkit™

The Aquapodkit™ provides temporary emergency water storage for use in bathtubs during emergency situations. The reusable fastening/locking/dispensing sleeve device of the Aquapodkit attaches to a disposable bladder. The sleeve device is designed to accommodate a pump or siphoning device to dispense the water as needed. The Aquapodkit is designed for a large volume of family emergency water storage.

The present invention provides a sanitary disposable container that can be used to accommodate a variety of fluids while eliminating the need for constant cleaning. It is adaptable to existing backpack, waist attached or similar receptacle hydration product.

BRIEF SUMMARY OF THE INVENTION

The present invention was designed to address the hydration needs of the active person while considering sanitation issues and ease of use. In one embodiment, it comprises a disposable liquid container, a sleeve fastening system comprising an inner sleeve and an outer sleeve, a reusable outer support and drinking tube with mouthpiece.

In this specification, the term "sleeve" refers broadly to either a first "inner sleeve" component or a second "outer sleeve" component, where the first component is maintained in close proximity to a second component. As illustrated in the examples below, the relationship between these components may include, but is not limited to, a snug compression fit between smooth surfaces on both components; a snap fit between recessed and projecting features on the surfaces of the components; a threaded connection between surfaces of the components; or other connection such as a pin and slot connection where the components are locked with a partial turn of one component relative to the other component. One aspect of the current invention is the ability to seal an opening of a disposable bag by sealing the periphery of a hole between portions of an inner sleeve and an outer sleeve.

The inner sleeve and outer sleeve have a hollow core that permits filling and/or insertion of a drinking tube.

In some embodiments, a cap is provided as a separate component removably attachable to the outer sleeve by compression fit, snap fit, threaded fit, or other closure mechanism such as pin and slot connection. These embodiments are generally referred to as "three-part closure devices" where the three parts are an inner sleeve, an outer sleeve, and a cap.

In other embodiments, the cap is provided as part of the outer sleeve. These embodiments are generally referred to as "2 part closure devices" where the two parts are an inner sleeve, an outer sleeve with integral cap.

This individual hydration system may be housed inside a backpack, fanny pack, or similar receptacle. Regular backpacks or those backpacks designed specifically for the hydration reservoir may be used to accommodate a disposable liquid container and a sleeve fastening system. The disposable liquid container or liner, with attachments, may be placed inside the existing permanent reservoir of the existing hydration backpack; inside the hydration backpack without the permanent reservoir; or inside the housing receptacle with the reusable outer support. In some embodiments, the inner sleeve or outer sleeve includes a handle with a hook or slot, such that the handle can be aligned with a hook or other support feature provided on the backpack or carrier.

The present invention provides a disposable container that is easy to use and sanitary while eliminating the stains and flavors that affect the permanent reservoirs of the existing products.

BRIEF DESCRIPTION OF DRAWINGS

FIG. 5A shows the neck of a plastic bag inserted into the inner opening in the inner sleeve, and rolling the bag neck past the inner sleeve lip.

FIG. 5B shows the outer sleeve being slid onto the inner sleeve.

FIG. 5C shows the cap pushed over the outer sleeve.

FIG. 5D shows the cap pushed over the outer sleeve until the cap side wall is tightly seated against the outer sleeve.

FIG. 5E shows a single section drinking tube which may be partially inserted into the hole in the cap.

FIG. 6A shows an embodiment of the current invention where a gasket is provided on the bag, and a lip on the bottom portion of the outer sleeve snaps into a groove on the bottom portion of the outer sleeve.

FIG. 6B shows the bottom lip of the inner sleeve inserted into the bag through the hole.

FIG. 6C shows the outer sleeve snapped onto the cylindrical portion of the inner sleeve.

FIG. 6D shows the cap 160 is secured to the outer sleeve.

DESCRIPTION OF EMBODIMENT

Three-Part Closure Device with Smooth Sleeves

The following element list is presented for convenience in reviewing the drawings which represent example embodiments of the current invention.

In one example, the inside sleeve has an inner opening of about 2.6 inches (66 mm); and the lip and gasket have a width of about ⅛ to ¼ inch (3-6 mm).

Figure 4:
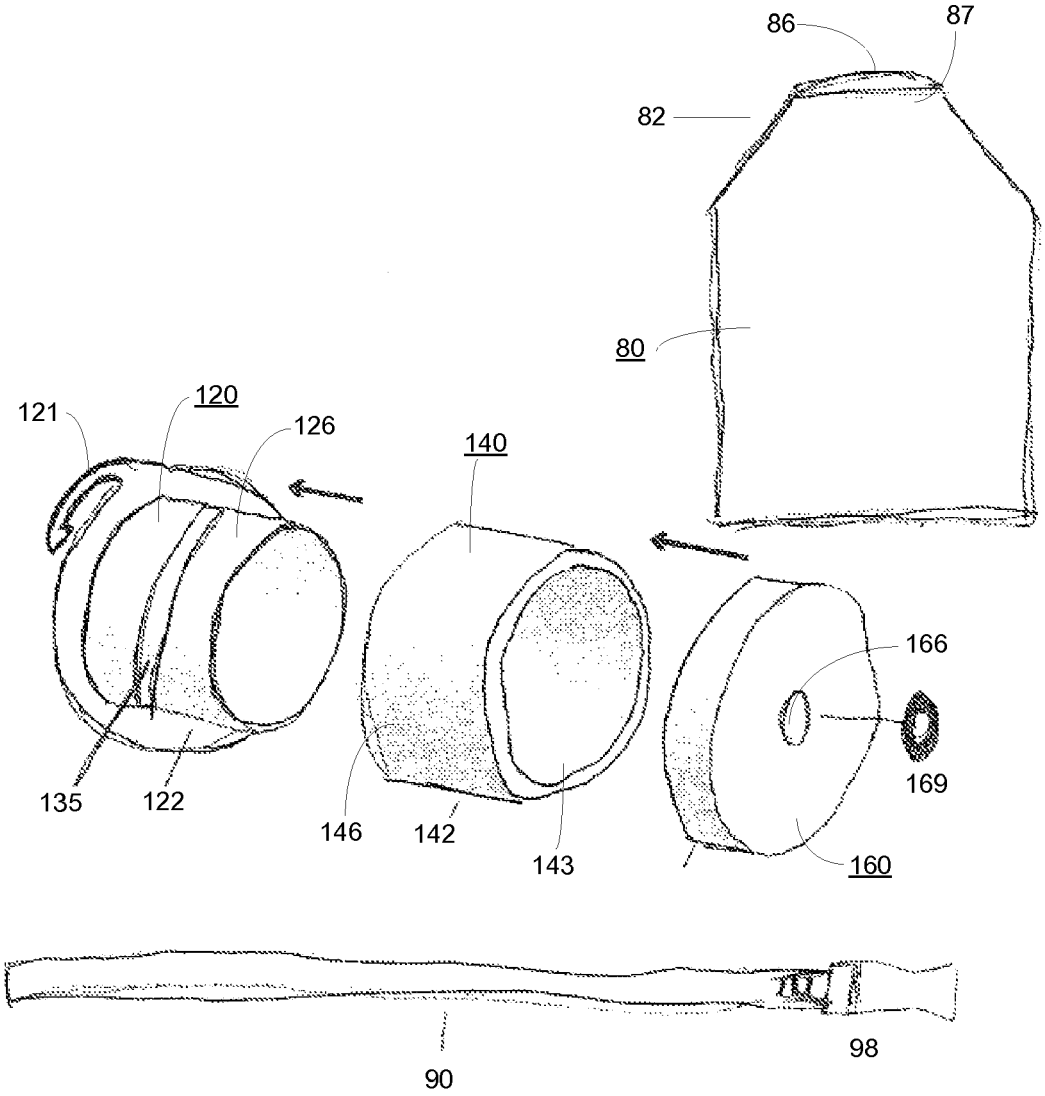
FIG. 4 is an exploded front view of components in a smooth sleeve embodiment of the current invention.

In one embodiment, the present invention comprises a disposable liquid bag container 80, a sleeve fastening system 100, a drinking tube assembly 90 with mouthpiece and an optional reusable outer bag carrier 70 with "hook" as shown in FIGS. 4 and 5.

Sleeve Fastening Assembly

FIG. 4 is an exploded front view of components in one embodiment of the current invention. In this embodiment, a three-piece "sleeve" assembly is used to create a secure seal at opening of plastic bag for use with a drinking tube. The inner sleeve 120 is inserted through the hole. over a portion of the bag periphery material which surrounds a hole in the bag. The bag material around the hole is termed "hole periphery of bag material".

The bag portion preferably extends to cover the lip 122 on the bottom of the inner sleeve. The bag material is then pulled down over the outside of the inner sleeve so that the bag periphery of hole material is pulled over the outside wall 128 of the cylindrical extension portion 126; and the outer sleeve 140 is pushed over the inner sleeve and bag portion and forced against the lip. This configuration provides a retention force on the bag portion on both the outer surface of the inner sleeve and on the lip, thereby resisting slippage of the bag portion.

The lip surface may be textured, or have surface profile features, to help engage a portion of the bag periphery material and to resist slippage of the bag periphery material.

Testing of this design has shown good leakage resistance and durability.

Assembly Method

FIGS. 5A-5E are exploded front views showing a sequence of assembly steps for the components in FIG. 4 over the neck of a bag 80.

Figures 5A, 5B, 5C, 5D, 5E:
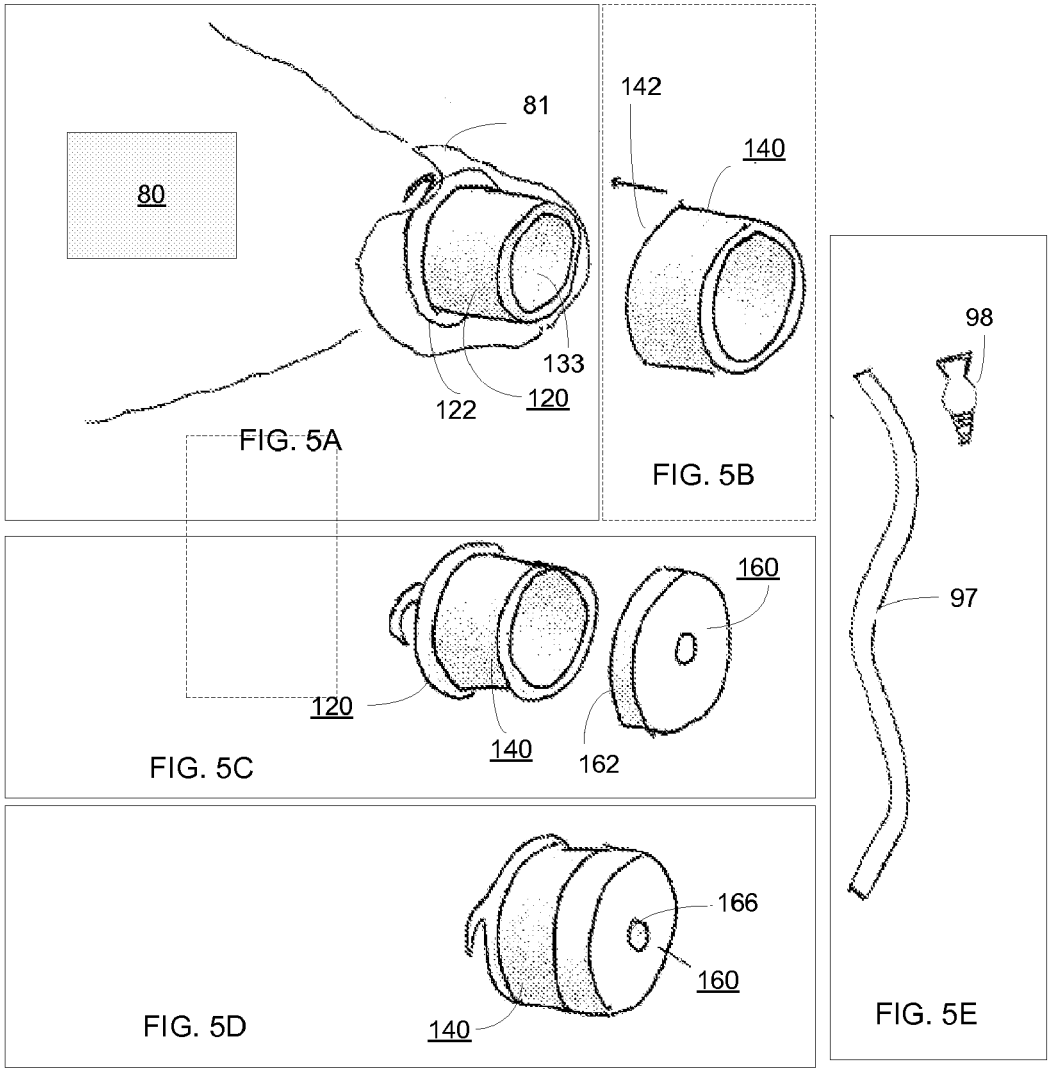
FIGS. 5A-5E are exploded front views showing a sequence of assembly steps for the components in FIG. 1 over the neck of a bag.

At the first step shown by FIG. 5A, the neck 81 of a plastic bag 80 is inserted into the inner opening 133 in the lip 122 and the cylindrical extension portion 126 of the inner sleeve 120. The neck of the plastic bag is then rolled, like a shirt sleeve, until excess plastic extends approximately one inch from the lip 122 base of the inner sleeve. Optionally, one or more clamp, such as a rubber band, may be provided to seal the neck portion of the bag against the inner sleeve.

At the second step shown by FIG. 5B, the outer sleeve 140 is slid onto the inner sleeve 120 until it "seats" snugly over inner sleeve, such that the first end 142 of the outer sleeve 140 is in proximity to the lip 122 of the inner sleeve. The hole periphery of bag material 87 is then secured between the inner sleeve and the outer sleeve.

At the third step shown by FIG. 5C, the cap 160 is pushed over the outer sleeve until the cap side wall 162 is tightly seated against the outer sleeve as shown in FIG. 5D. Optionally, the cap may be threaded onto the outer sleeve, or other cap attachments may be used, such as a pin and slot attachment.

When placing the neck of the bag into the inner sleeve with lip and folding the plastic back over the sleeve and then sliding the outer sleeve over the plastic and inner sleeve, a substantial opening is provided to fill the container before sealing. This feature permits easier manual filling or machine filling. The optional handle facilitates lifting, holding or pouring; and provides a way to support the bag in a backpack or carrier. In this example, the bag may be filled with a fluid at the time that the outer sleeve is inserted on the inner sleeve; or the bag and sleeves may be stored for later use. During a fluid fill operation in this example, the sleeves are typically grasped and held while the bag is filled.

At the fourth step shown by FIG. 5E, a single section drinking tube is partially inserted into the hole 166 in the cap 160 so that part of the tube section 97 is inside the bag and part of the tube section 97 is outside the bag. A rubber grommet or o-ring 169 may be provided as a seal between the hole and the drinking tube. In another example, the hole may be slightly smaller than the drinking tube in order to provide compression of the tube in the hole. A mouthpiece 98 is typically connected to the tube section. The assembly is then ready for use.

In other examples, other drinking tube assemblies may be used, such as connectors with valves, and multiple tube sections as described below.

Bag Type

In this example, open-top bags may be provided. As described below, other embodiments typically provide a fill hole in the side of a bag. A 4 mm thick low density polyethylene bag has worked effectively.

Backpacks and Other Hydration Bag Carriers

Figure 1:
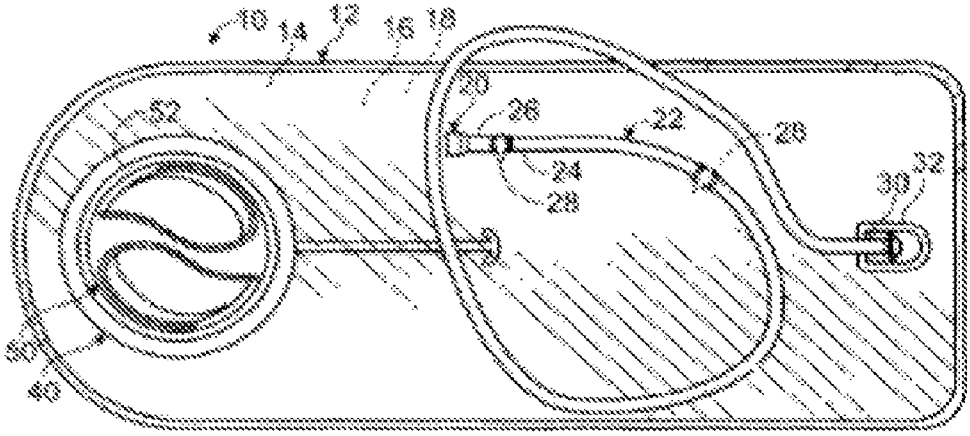
FIG. 1 (PRIOR ART)
FIG. 1 is a top view a prior art device.
Figure 2:
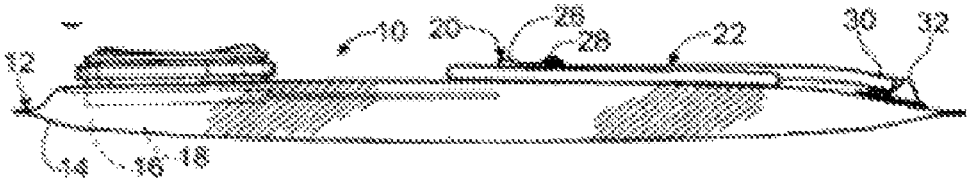
FIG. 2 (PRIOR ART)
FIG. 2 is a side view of the prior art device of FIG. 1.
Figure 3:
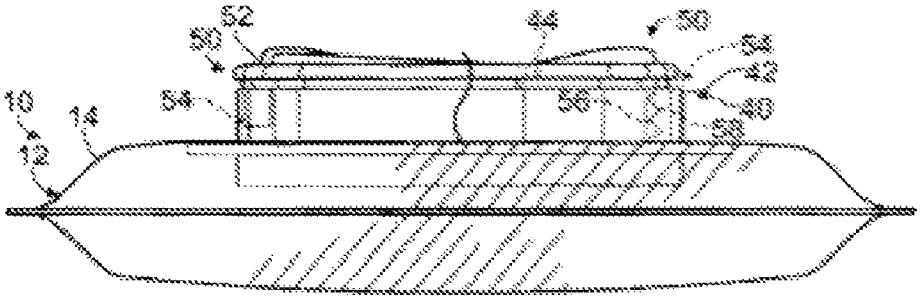
FIG. 3 (PRIOR ART)
FIG. 3 is a partial end view of the prior art device of FIG. 1.

Prior art hydration systems typically comprise a housing receptacle, such as a backpack, and a permanent reservoir. As illustrated by FIG. 1, the permanent reservoir has a drinking tube with mouthpiece which is attached to and extends from the lower portion of the reservoir. The upper portion of the permanent reservoir has an input or fill port with tethered lock. The fill port has a molded plastic "hook" which is used to secure the reservoir in the housing receptacle.

This embodiment of the present invention comprises a disposable fluid container which is attached to the reusable sleeve fastening assembly which provides fastening, locking, and dispensing. In this example, the inner sleeve is provided with a hook 121 so that the device may be supported in a backpack or carrier 70.

The disposable hydration bag assembly of the current invention can be placed or stored in anything that can support its weight. Some examples of places to use a disposable bag assembly include, but are not limited to coolers, backpacks, carrying bags, waist holders and fanny packs.

The present invention with disposable liquid container bag or liner may be placed inside an existing permanent reservoir by removing the tethered cap and outside drinking tube. Another option includes placing the present invention inside a reusable outer support which may then be placed inside a housing receptacle such as a backpack.

Uses

When the locking sleeve device is used, the contents of bag can be mixed, combined, or manipulated. This feature is useful when adding popular instant drink mixes or drink tablets.

The disposable bag hydration system can accommodate larger or smaller storage containers and a variety of liquids.

This device can be made in varying sizes to accommodate the container and contents and in varying materials. This device can also connect to other fasteners, tubes and hoses for dispensing. This system may be completely disassembled to aid in cleaning the sleeve components and drinking tube assembly.

Drinking Tube Assembly

In the example shown, the drinking tube assembly comprises a single tube comprising a portion inside the bag, a portion extending through a hole in the cap, and a portion external to the bag. The hole in the cap may have a snug fit to the drinking tube, or may include a seal element such as an o-ring.

In other embodiments, the hole in the cap may be threaded to accept a drink tube connector such as described below. This drink tube connector typically includes an integral shut-off valve.

In another example, a valve may be attached to, or fabricated on the cap. One type of valve is a "Push-pull-cap", such as those used on water bottles. In this example, a section of drink tube may be provided in the bag below the cap.

Surface Finish and Features

The example illustrated above describes a snug compression fit between the smooth surface outside wall 128 of the inner sleeve and a smooth inside surface 143 of the outer sleeve 140. In alternative embodiments, one or both of these surfaces may be textured or grooved in order to provide additional resistance to bag slippage.

Reuse of Components

In this embodiment, all components of the sleeve fastening assembly and drinking tube assembly are reusable and adaptable allowing the consumer to replace only the disposable hydration bag. This translates into substantial financial savings for the consumer.

Three-Part Closure Device with Gasket on Bag

Figure 6A:
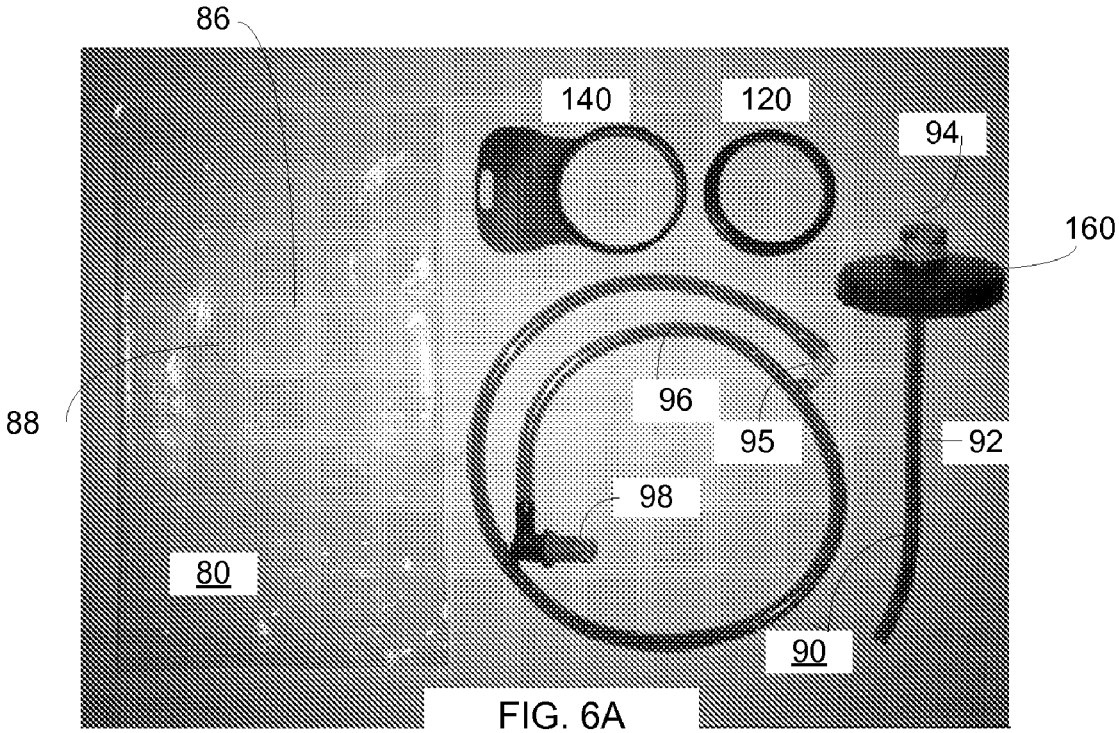
FIGS. 6A-6D are exploded front view of components and assembly sequence in an embodiment of the current invention.

FIG. 6A is a top view showing the parts of an embodiment of the current invention. This embodiment comprises a three-part closure device having an inner sleeve, an outer sleeve, and a cap; and the bag is provided with a gasket or o-ring around the fill hole opening. The components include a bag 80 with a hole 86 and gasket 88, an inner sleeve 120; an outer sleeve 140; a cap 160; and a drinking tube assembly 90 comprising an in-bag tube section 92, an, a cap seal element 94, a mouthpiece 98, a mouthpiece tube section 96, and a cap tube attachment element 95. In this example, the hole 86 is provided in the side of the bag, which is a common orientation of the fill hole of prior art hydration systems.

Method of Assembly and Use

Figure 6B:
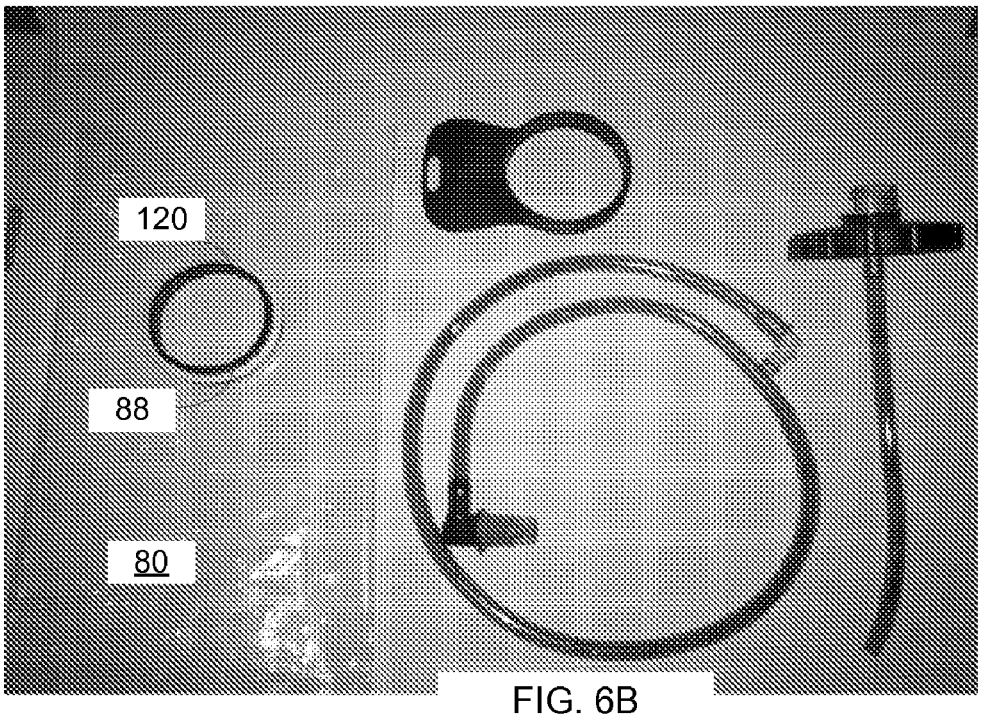
Figure 6C:
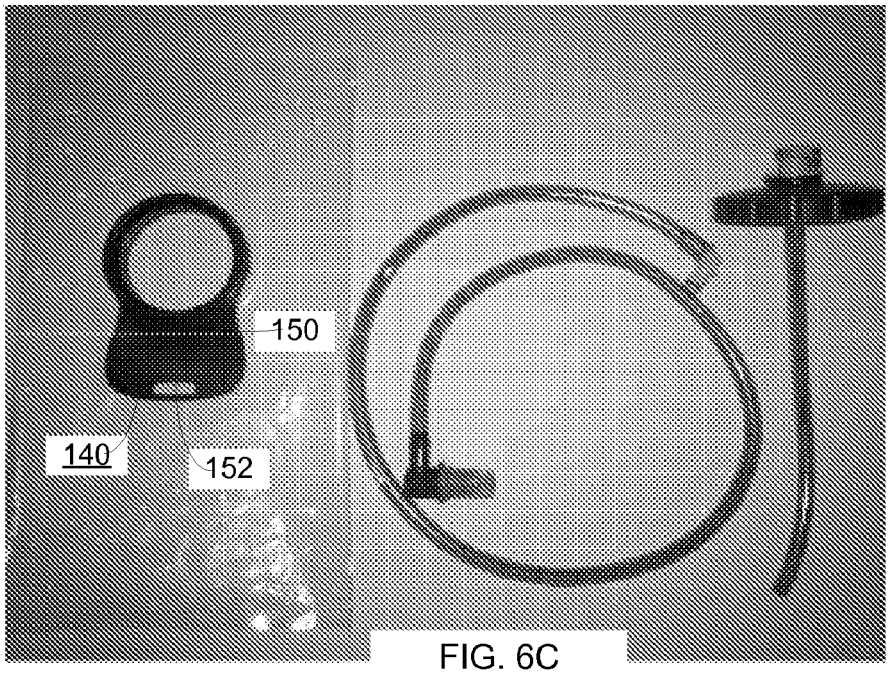
Figure 6D:
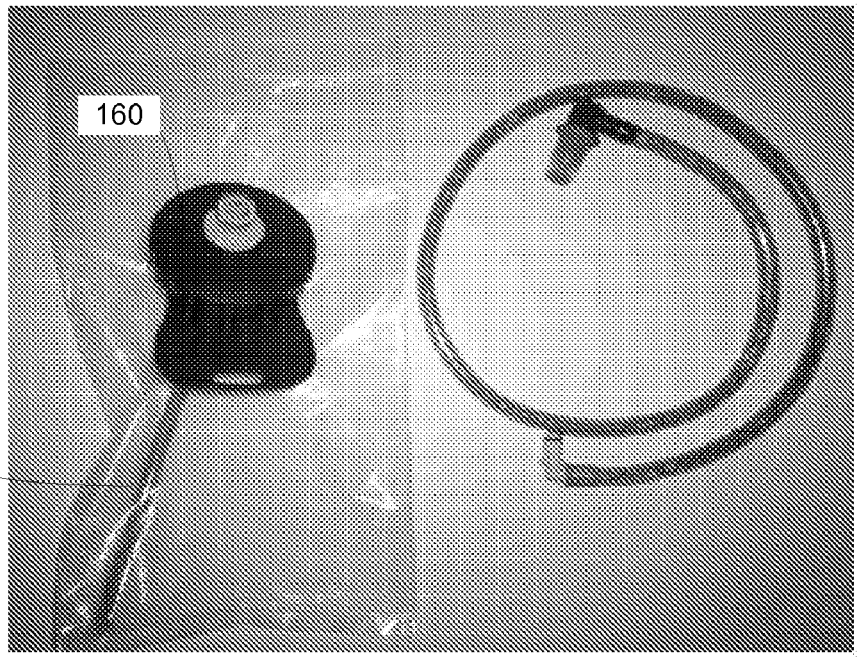

In one example of use, the following steps are performed as illustrated in FIGS. 6B-6D which are top views showing the sequence of assembly of a device.

At step 1000, the bottom lip 122 of the inner sleeve 120 is inserted into the bag 80 through the hole 86 as illustrated in FIG. 6B. The gasket or o-ring is compliant, and is typically elongated into an ellipse-shape in order to insert the inner ring. In one example, the inside sleeve has an inner opening of about 2.6 inches (66 mm); and the lip and gasket have a width of about ⅛ to ¼ inch (3-6 mm).

Figure 8:
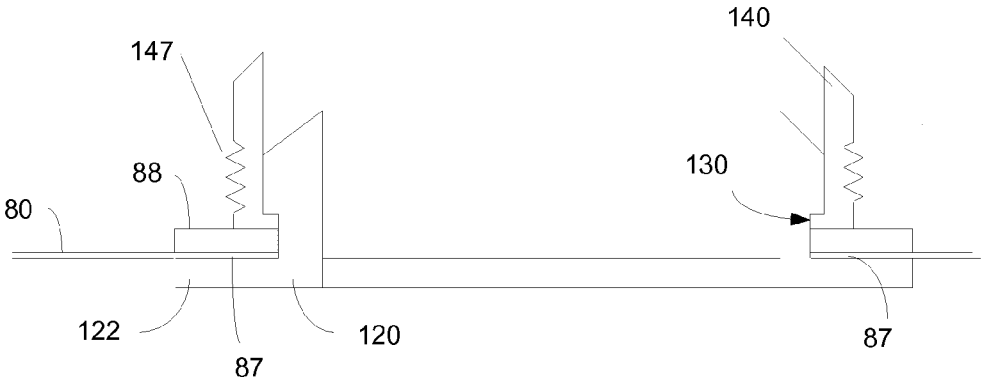
FIG. 8 is a detailed cross section view of a portion of the bag and gasket and an example inner ring element.

FIG. 8 is a detailed cross section view of a portion of the bag and gasket and an example inner sleeve element 120. In this example, inner sleeve has a bottom lip 122. The bottom lip 122 has a top surface 123, and the gasket 88 is attached to the bag at a hole 86 in the bag. In this example, a portion of the bag 80 around the hole, the hole periphery of bag material 87, is sandwiched between the gasket and the top surface 123 of the bottom lip 122. The gasket 88 is typically stretched slightly to fit over the cylindrical portion 126 of the inner ring, so that it fits snugly against the sidewall of the bottom groove 130 of the inner sleeve.

At step 1100, the outer sleeve 140 is snapped onto the cylindrical portion 126 of the inner sleeve 120 as shown in FIG. 6C. In this example, a handle 150 is provided on the outer sleeve. The handle includes a backpack attachment element 152, which is a slot. In this example, the handle and backpack attachment element are oriented downwardly. In other examples, the handle may be oriented in other directions.

Referring again to FIG. 8, the outer sleeve element 140 is snapped onto the cylindrical portion 126 of the inner sleeve 120. In this example, the outer sleeve 140 has a cylindrical portion 142 with a bottom lip 145 extending from the inside surface 144. As the outer sleeve is pressed onto the inner sleeve, the lip 145 engages the top portion of the bottom groove 130 of the inner sleeve, thereby maintaining a compressive force against the gasket into the bottom lip 122 of the inner sleeve 120. This compressive force provides a seal for the bag contents.

At step 1200, the bag may be filled while holding the handle 150 of the outer sleeve.

At step 1300, the cap 160 is secured to the outer ring as illustrated in FIG. 6D, such that the in-bag tube section 92 of the drinking tube assembly is placed inside the bag.

At step 1400, the mouthpiece tube section 96 is attached to the cap seal element.

Drinking Tube Assembly

In this example, the length of the in-bag tube section 92 of the drinking tube assembly is selected to be about the distance from the center of the cap to a bottom corner of the bag. This length helps to retain the bottom of the in-bag tube section near the bottom corner of the bag.

One example of drinking tube assembly is to provide a rotatable connector such as United States Plastic Corp. Part No. 60656 "Bulkhead Panel Mounted Hose Barb Body & Shutoff" in the cap so that a lower portion of the connector has a hose barb for attaching the in-bag tube section 92, and the upper portion of the connector has a shutoff connection. The mouthpiece tube may be attached to the barb end of United States Plastic Corp. Part No. 60658 "Hose Barb Insert with Shutoff", and that part is attachable to the rotatable connector.

The mouthpiece tube section 96 of the drinking tube may have a Y-connector such as United States Plastic Corp. Part No. 64116 to permit the contents of the bag to be shared. Each mouthpiece section(s) may include a dispensing valve. The mouthpiece tube section 96 is typically long enough to reach from the cap to the mouth of a user.

At step 1500, the filled bag is placed in a carrier such as a Camelbak™ pouch. The bag is typically held in the pouch with a notch 154 or hook engaging a portion of the carrier.

At step 1600, the user may drink from the mouthpiece.

At step 1700, the user may re-fill the bag by removing the cap.

At step 1800, the user may replace the bag by removing it from the carrier and repeating steps 1000-1500.

Cap

The term "cap" refers generally to a closure device that directly or indirectly seals the inner sleeve opening. In most embodiments, this sealing can be accomplished at the inner sleeve opening by using a threaded or non-threaded plug inserted into the inner sleeve opening. The sealing can be accomplished by providing an outer sleeve that extends above the inner sleeve, and using a threaded or non-threaded plug inserted into the outer sleeve opening. In many of the embodiments described above the "cap" extends over the outer sleeve opening and is affixed to the outside wall of the outside sleeve, such as with threads, compression fit, clamp, or pin and slot connection. In this case, the seal is typically achieved between the inside of the "cap" and the top of the outside sleeve. This seal may include a bushing, gasket, or o-ring in the "cap". Another example of a cap closure element is a clamp, such as a wire clamp similar to the clamps used on mason jars.

Three-Part Closure Device with Compressible Bead Formed on Bag

Figure 7:
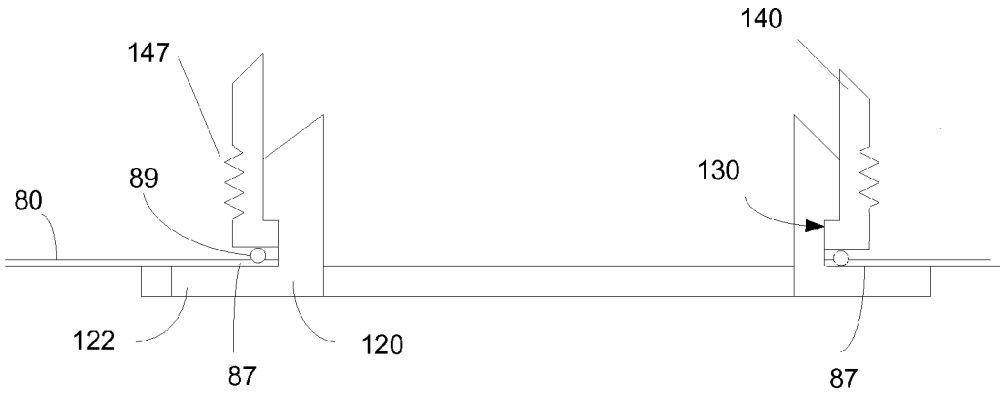
FIG. 7 is a detailed cross section view of a portion of a bag with a bead 89 or raised portion provided around the hole in the bag.

FIG. 7 is a detailed cross section view of a portion of a bag with a bead 89 or raised portion provided around the hole in the bag. In this embodiment, the gasket is replaced with a compressible feature such as a bead provided directly on the bag. The hole periphery of bag material 87 is secured between the inner sleeve and the outer sleeve.

Figure 9:
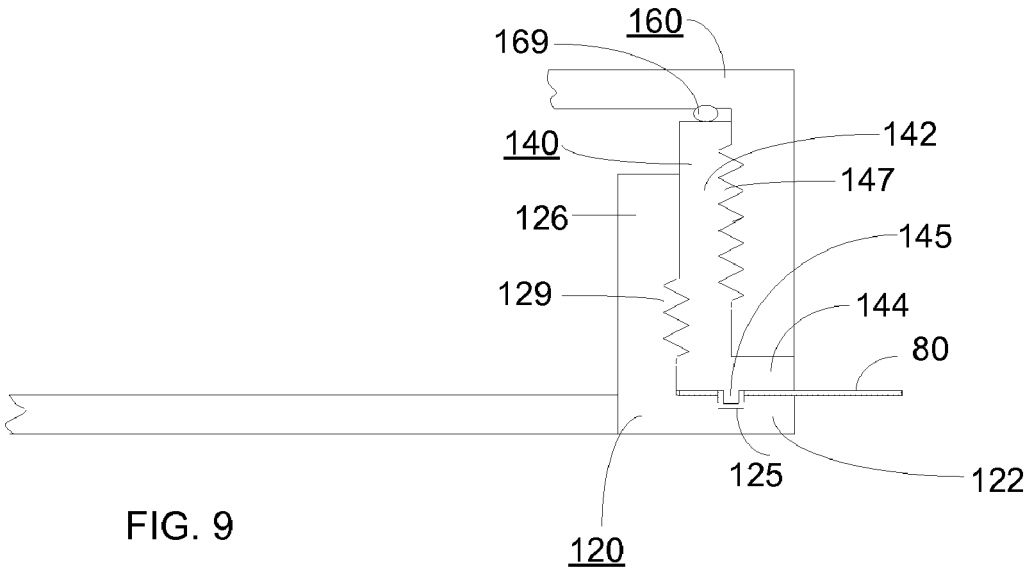
FIG. 9 is a cross section view of an example embodiment where a single groove is provided on the bottom lip of the inner sleeve; and an annular projection is provided on the bottom surface of a lip on the outer sleeve.

3-Part Threaded Closure Device with Groove and Projections Provided on Inner and Outer Sleeve Lips In this embodiment, a portion of the bag around the hole is compressed between mating groove and projection features on the inner and outer sleeve. FIG. 9 is a cross section view of an example embodiment. In the example of FIG. 9, a single groove 125 is provided on the bottom lip 122 of the inner sleeve 120; and annular projection 145 is provided on the bottom surface of a lip 144 on the outer sleeve. In the example of FIG. 12, the outer sleeve is threaded onto the inner sleeve in order to achieve a compressive force to squeeze a portion of the bag 80 between the lips and specifically between the projection and the groove.

Figure 11A:
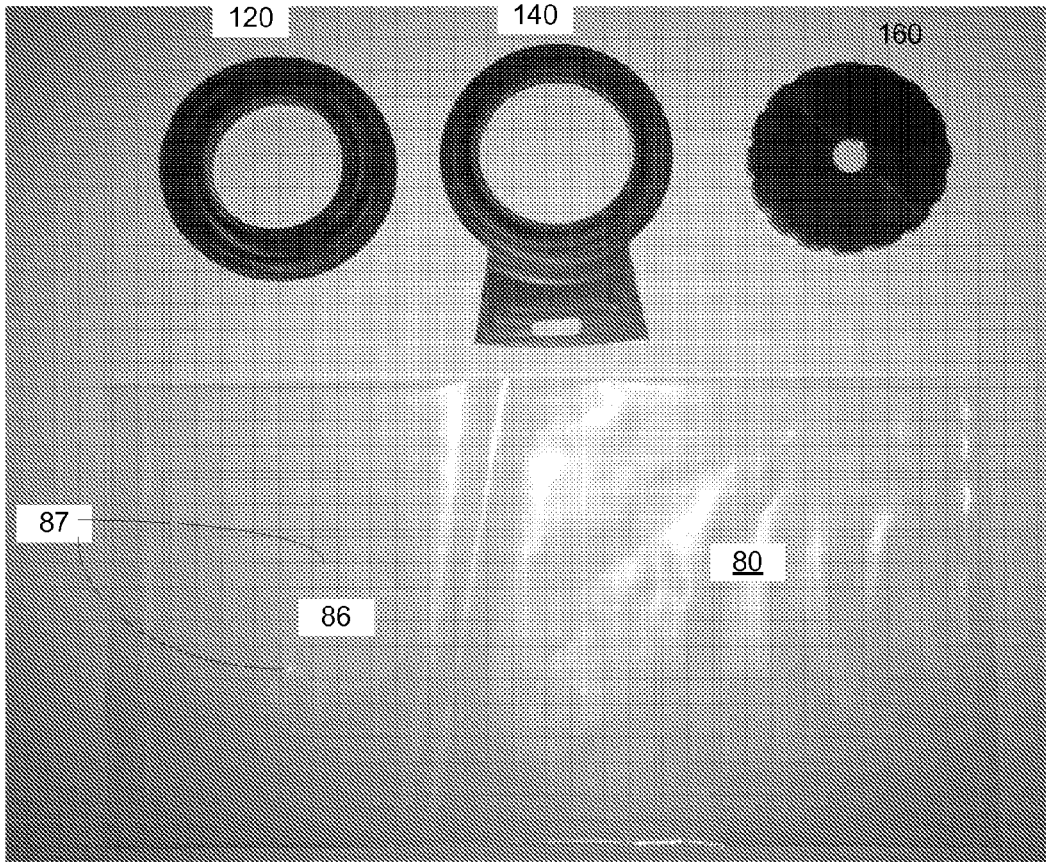
FIG. 11A is an exploded top view of one embodiment the current invention where the outer sleeve threads onto the inner sleeve, and a portion of the bag is secured between a groove on the inner sleeve lip and an annular projection on the bottom surface of the outer sleeve.
Figure 11B:
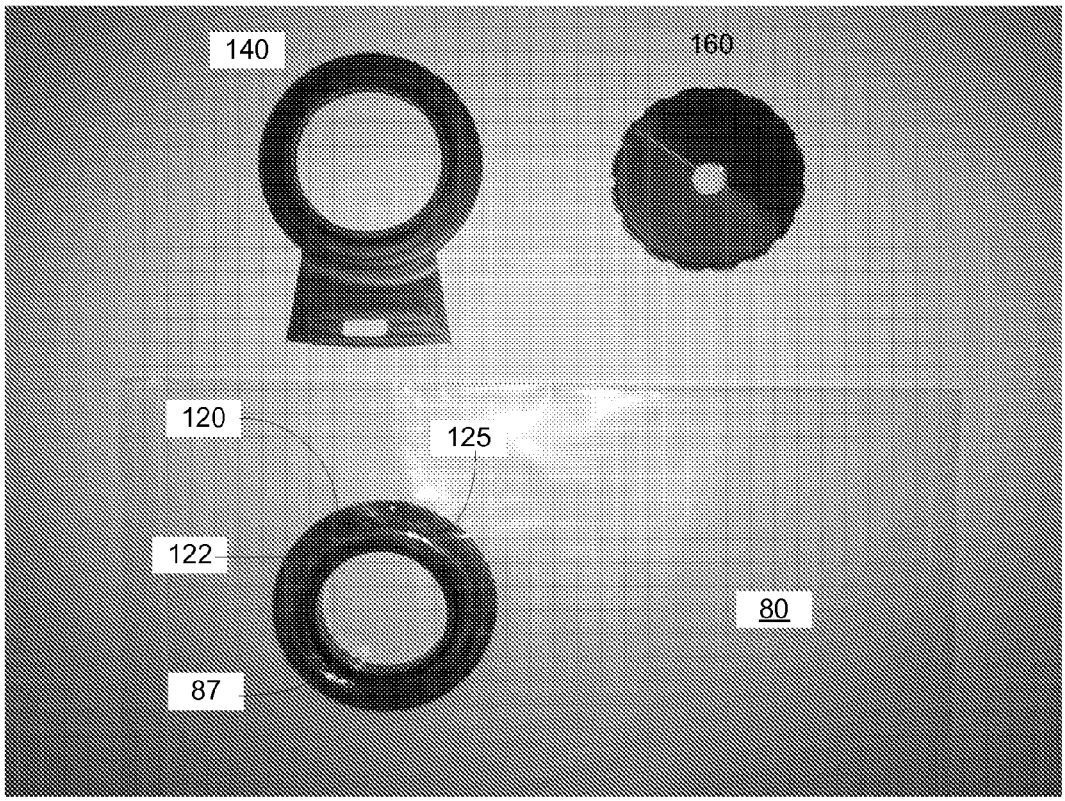
FIG. 11B is an exploded top view of the embodiment of FIG. 11A where the inner sleeve has been inserted into a hole in the bag so that the hole periphery of bag material overlaps a mating feature on the bottom lip of the inner sleeve.

FIG. 11A is an exploded top view of one embodiment having the cross section of FIG. 9 where where the outer sleeve threads onto the inner sleeve, and a portion of the bag is secured between a groove on the inner sleeve lip and an annular projection on the bottom surface of the outer sleeve. FIG. 11B is an exploded top view of the embodiment of FIG. 11A where the inner sleeve has been inserted into a hole in the bag so that the hole periphery of bag material 87 overlaps a mating feature 125 on the bottom lip 122 of the inner sleeve 120. When the outer sleeve is threaded, or otherwise attached, to the inner sleeve, the hole periphery of bag material 87 is secured between the inner sleeve and the outer sleeve.

In one example, the inside sleeve has an inner opening of about 2.6 inches (66 mm); the lip 122 has a width of about ⅜ to ¾ inch (9.5-19 mm).

In other examples, the feature profiles may be changed, such as by providing multiple sets of grooves and annular projections may be provided, and the groove portions can be on either or both of the inner sleeve and outer sleeve In other examples, other attachment means can be provided between the inner sleeve and the outer sleeve, such as snap fit or a pin and slot mechanism.

Bottom Drinking Port

In the examples described above, a bag is provided with a single hole that is used for both filling the bag and drinking from the bag. Prior art devices typically provide a fill hole with a solid cap, and a separate drinking tube port at the bottom of the bag.

Figure 10:
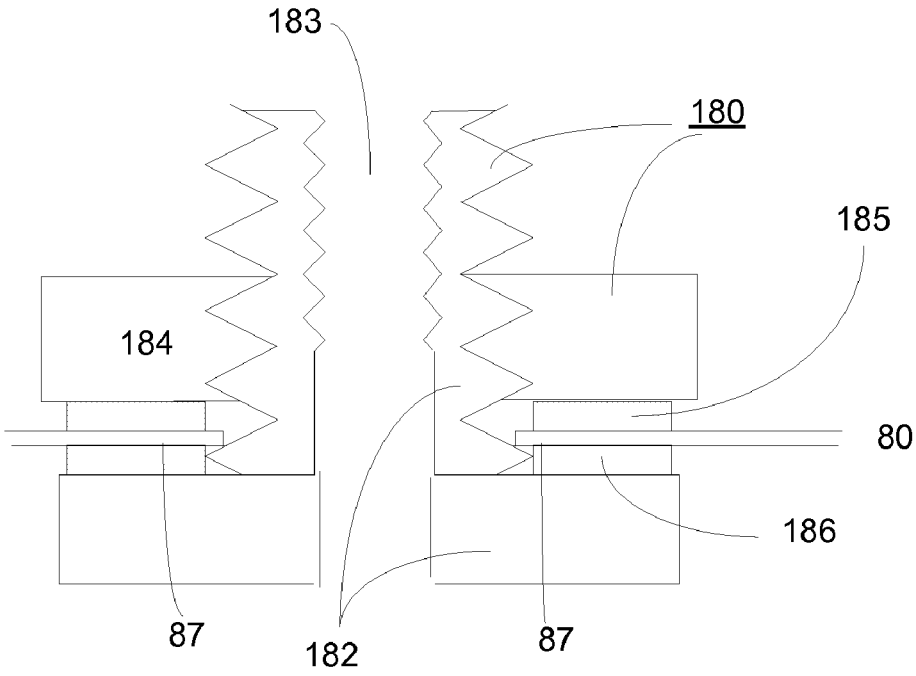
FIG. 10 is a detailed cross section view of a portion of the bag and a bulkhead fitting.

In one example of the current invention, the replacement bags may include a large hole and sleeve fastening assembly as described above, and a second smaller hole in a bottom portion of the bag. FIG. 10 is a detailed cross section view of a portion of the bag and a bulkhead fitting.

In this example, a removable bulkhead fitting, such as shown in FIG. 10 may be provided to seal the second hole and to attach connectors and drinking tube components such as those described above. In this example, the bulkhead fitting 180 comprises a bolt portion 182 with a threaded hole 183; a nut portion 184; and gaskets 185 and 186. Hole periphery bag material is sealed between the gaskets 185 and 186 as the nut portion is tightened onto the bolt portion.

Two-Part Closure Devices

Three-part closure devices comprise an inner sleeve, an outer sleeve, and a cap. A handle is typically provided on the outer sleeve so that the bag can be filled prior to installing the cap.

In this embodiment, two-part closure devices comprise and inner sleeve and an outer sleeve with integral cap. Since the cap may be fabricated with the outer sleeve, these embodiments provide reduced part count and reduced potential leakage points. The sealing of bag periphery material is between the inner and outer sleeve, such as described in the examples and embodiments above.

One method of filling bags with two-part closure devices is to grasp the inner sleeve and the bag; then to fill the bag; and then attach the combined outer sleeve and cap.

Another method of filling bags with two-part closure devices is to add fluid to the bag through the drinking tube.

Another method of filling bags with two-part closure devices is to assemble the combined outer sleeve and cap to the inner sleeve, and then to remove the tubing connector from the cap, and to fill the bag through the cap.

This description is not intended to be exhaustive or limiting, and variations of the current invention will be apparent to those skilled in the art.

What is claimed is:

1. A hydration bag system comprising
a disposable hydration bag comprising
a first hole,
a hole periphery of bag material surrounding the first hole, and
a second hole in the hydration bag having a hole periphery of bag material surrounding the second hole;
a bag sleeve fastening assembly comprising
an inner sleeve comprising
a bottom lip, and
a cylindrical extension from the bottom lip, the cylindrical extension
having an outer wall;
an outer sleeve comprising
an inner wall,
an outer wall,
a bottom in proximity to the bottom lip of the inner sleeve, and
a top,
the outer sleeve removably secured to the cylindrical extension of the inner sleeve, such that a portion of the hole periphery of bag material is retained between the inner sleeve and the outer sleeve, and
a cap;
a drink hole; and
a drink tube assembly comprising
a first tube, external to the hydration bag, the first tube having a proximal end connected to the drink hole, and a second end,
a removable bulkhead connector affixed to the bag, such that the bulkhead connector seals the hole periphery of bag material surrounding the second hole, such that the drink hole is through the bulkhead connector, and
a tube connector attached to the bulkhead connector, such that the proximal end of the first tube is attached to tube connector.

2. A hydration bag system
a disposable hydration bag comprising
a first hole,
a hole periphery of bag material surrounding the first hole, and
a second hole in the hydration bag having a hole periphery of bag material surrounding the second hole;
a bag sleeve fastening assembly comprising
an inner sleeve comprising
a bottom lip, and
a cylindrical extension from the bottom lip, the cylindrical extension
having an outer wall;
an outer sleeve comprising
an inner wall,
an outer wall,
a bottom in proximity to the bottom lip of the inner sleeve, and
a top,
the outer sleeve removably secured to the cylindrical extension of the inner sleeve, such that a portion of the hole periphery of bag material is retained between the inner sleeve and the outer sleeve, and
a cap;
a drink hole provided in the cap;
a drink tube assembly comprising
a first tube, external to the hydration bag, the first tube having a proximal end connected to the drink hole, and a second end,
a connector positioned with the drink hole, and
a second tube extending from the connector on the inside of the hydration bag;
wherein the cylindrical extension outer wall is smooth;
wherein the inner wall of the outer sleeve is smooth;
wherein the hole periphery of bag material is pulled through the inner sleeve and folded over the outer wall of the inner sleeve; and
wherein the outer sleeve is inserted over the inner sleeve outer wall such that the hole periphery of bag material is secured between the inner sleeve and the outer sleeve.

3. The bag system of claim 2 wherein
the cap is attached to the outer sleeve by a mechanism selected from the group consisting of compression fit, snap fit, threads, clamp, and pin and slot connection.

4. The bag system of claim 2 wherein
the inner sleeve further comprises a hook.

5. The bag system of claim 2 wherein
a gasket is provided on the hole periphery of bag material;

the outer wall of the inner sleeve cylindrical extension has a groove where the cylindrical extension intersects the bottom lip;

the inner sleeve is inserted into the hole such that the bottom lip of the inner sleeve is positioned under the gasket, and the inner sleeve cylindrical extension extends externally through the hole;

the outer sleeve has an outwardly extending annular projection along the bottom of the inner wall, such that the annular projection mates with the groove; and the outer sleeve is inserted over the inner sleeve outer wall until the annular projection snaps into the groove, thereby maintaining a compressive force on the gasket between the outer sleeve and inner sleeve lip.

6. The bag system of claim 5 wherein a cap is attached to the outer sleeve by a mechanism selected from the group consisting of compression fit, snap fit, threads, clamp, and pin and slot connection.

7. The bag system of claim 5 wherein the outer sleeve further comprises a handle.

8. The bag system of claim 2 wherein a bead is provided on the hole periphery of bag material;

the outer wall of the inner sleeve cylindrical extension has a groove where the cylindrical extension intersects the bottom lip;

the inner sleeve is inserted into the hole such that the bottom lip of the inner sleeve is positioned under the bead, and the inner sleeve cylindrical extension extends externally through the hole;

the outer sleeve has an outwardly extending annular projection along the bottom of the inner wall, such that the annular projection mates with the groove; and the outer sleeve is inserted over the inner sleeve outer wall until the annular projection snaps into the groove, thereby maintaining a compressive force on the bead between the outer sleeve and inner sleeve lip.

9. The bag system of claim 8 wherein a cap is attached to the outer sleeve by a mechanism selected from the group consisting of compression fit, snap fit, threads, clamp, and pin and slot connection.

10. The bag system of claim 8 wherein the outer sleeve further comprises a handle.

11. The bag system of claim 2 wherein the inner sleeve has a first mating feature on its bottom lip;

the outer sleeve has a bottom surface with a second mating feature;

a portion of the hole periphery of bag material is positioned between the first mating feature and the second mating feature;

the outer sleeve is secured to the inner sleeve by a mechanism selected from the group consisting of compression fit, snap fit, threads, clamp, and pin and slot connection, thereby providing a compressive force between the first mating feature and the second mating feature, such that the first mating feature is a groove and the second mating feature is an annular projection.

12. The bag system of claim 11 wherein a cap is attached to the outer sleeve by a mechanism selected from the group consisting of compression fit, snap fit, threads, clamp, and pin and slot connection.

* * * * *